United States Patent [19]

Kosson et al.

[11] Patent Number: 4,917,178

[45] Date of Patent: Apr. 17, 1990

[54] HEAT PIPE FOR RECLAIMING VAPORIZED METAL

[75] Inventors: Robert L. Kosson, Massapequa; John Quadrini, Northport; Ronald S. Dluginski, Garden City Park, all of N.Y.

[73] Assignee: Grumman Aerospace Corporation, Bethpage, N.Y.

[21] Appl. No.: 353,417

[22] Filed: May 18, 1989

[51] Int. Cl.[4] ..... F28D 15/02; F28B 1/02

[52] U.S. Cl. ..... 165/111; 165/32; 165/104.27

[58] Field of Search ..... 165/32, 104.27, 104.26, 165/111

[56] References Cited

U.S. PATENT DOCUMENTS

| | | | |
|---|---|---|---|
| 3,782,449 | 1/1974 | Busse et al. | 165/32 |
| 4,033,406 | 7/1977 | Basiulis | 165/32 |
| 4,207,027 | 6/1980 | Barry et al. | 165/104.26 |
| 4,674,562 | 6/1987 | Bassani et al. | 165/104.27 |

*Primary Examiner*—Albert W. Davis, Jr.
*Attorney, Agent, or Firm*—Pollock, VandeSande & Priddy

[57] ABSTRACT

A heat pipe including evaporator and condenser sections is located within a stack for reclaiming vaporized metals. The heat pipe is a variable conductance design which employs a communicating reservoir of non-condensable gas for creating a variably positioned interface with the working fluid within the condenser of the heat pipe. The interface varies as a function of the heat load on the condenser and effectively provides a variable control for maintaining efficient, fairly constant heat transfer across the wall of the condenser. Fixed turbulators are mounted to a lower section of the heat pipe for mixing the vaporized metals flowing through the stack thereby increasing the efficiency of heat transfer between the vaporized metals and the heat pipe. The result is a compact and environmentally rugged heat pipe design.

2 Claims, 1 Drawing Sheet

HEAT PIPE FOR RECLAIMING VAPORIZED METAL

FIELD OF THE INVENTION

The present invention relates to heat pipes, and more particularly to a heat pipe adapted for insertion in an effluent stack handling vaporized metals.

BACKGROUND OF THE INVENTION

In the manufacture of vaporizable metals, such as magnesium, an effluent is produced by a furnace wherein the metal is being refined. It is important to reclaim as much of the metal as possible in the effluent stack for two reasons. The first is to control potential pollution problems and the second is to reclaim as much of the metal as possible for financial benefit.

In the past, heat pipe designs have been employed which expose a water-filled evaporator to the hot stack gases. As the water vaporizes it is collected at a condenser in normal reflux action. The cooling of the vaporized metal on the exterior wall of the condenser can then be gravity fed from the stack for collection. The utilization of a water-filled heat pipe employing such evaporator and condenser sections is undesirable because the external temperature must be kept below the boiling point of water. Clearly, the attempt to do so in a stack through which a vaporized metal is flowing would present dimensional and control problems.

Suggestions have previously been made to employ a variable conductance heat pipe which modifies the basic evaporator-condenser combination by introducing a charge of non-condensable gas into the condenser which establishes a variably positioned interface within the condenser, depending upon the heat load of the condenser. Such a design is more efficient than the conventional fixed conductance heat pipes but a direct correlation between the volume of the non-condensable gas and the condenser detracts from the compactness of an overall heat pipe unit.

BRIEF DESCRIPTION OF THE INVENTION

The present invention is an improved variable conductance compact heat pipe which employs a solid plug within the center of the condenser section, leaving an annular passageway through the condenser for heat pipe fluid exchange. The length of the condenser may be chosen to present a sufficient heat exchange surface for expelling heat therefrom while including a volume-consuming plug which decreases the internal volume of the condenser section and, consequently, reduces the necessary volume for a reservoir containing non-condensable gas. The latter situation arises since a particular volume is desired for the ratio of the reservoir volume to that of the condenser section volume.

It is possible to include fixed turbulators on the outside of the present heat pipe for the purpose of mixing the vapors within a stack while they flow over the heat pipe. This breaks up the vapor and achieves better heat transfer between the stack vapors and the heat pipe. This can increase the efficiency of the present design and renders it more compact.

In order to avoid high pressure steam problems that arise with the utilization of water as a working fluid as previously discussed, the present invention employs a liquid metal, such as potassium as the working fluid.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
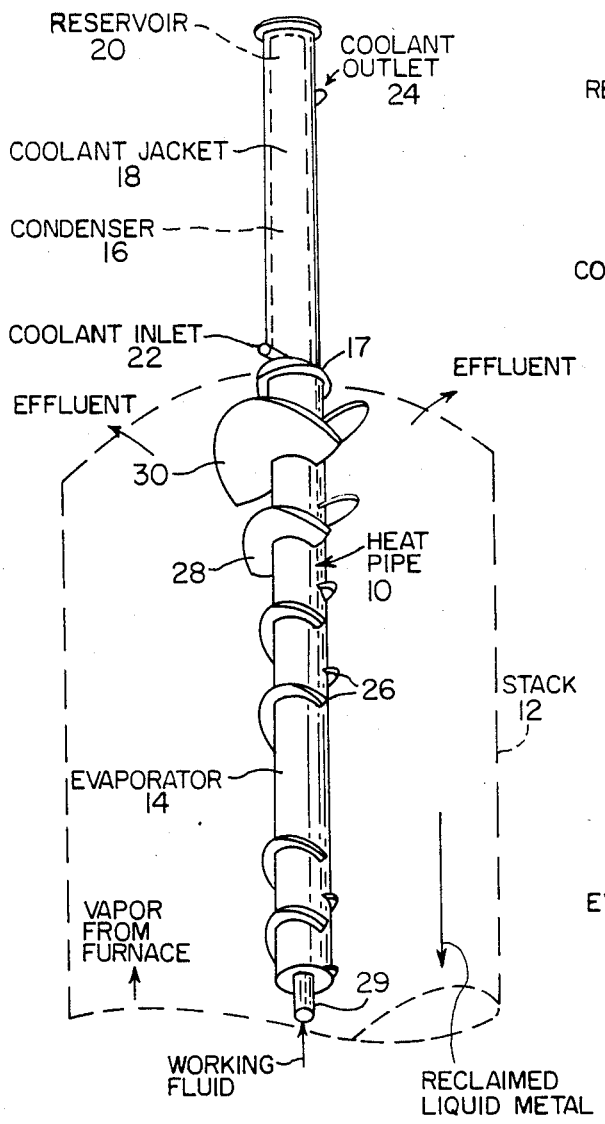
FIG. 1 is a perspective view of the present invention.

Referring to the figures and more particularly FIG. 1 thereof, a side view of the present invention is illustrated. The variable conductance heat pipe of the invention is generally indicated by reference numeral 10 and is seen to be positioned in relative location with an effluent stack 12, which may, by way of example, pass metallic vapors to the atmosphere from a furnace. The purpose of the heat pipe 10 is to condense these vapors to liquid which may then be gravity fed back down through the stack for collection as salable material. The liquefication of the metallic vapors occurs along the evaporator section 14 of heat pipe 10 wherein heat exchange from the vapors to the heat pipe occurs. The result is the formation of reclaimed liquid metal that becomes gravity fed back downwardly through the stack as indicated in the figure.

A secondary purpose is to condense these vapors thereby preventing them from entering the atmosphere and causing a pollution problem.

As in most heat pipes, an internal condenser section is necessary in order to permit constant heat exchange between the exterior of the heat pipe and the evaporator section. In the present invention the condenser section is shown in phantom at reference numeral 16, under coolant jacket 18. The details of the condenser and evaporator sections will be discussed in greater detail in connection with FIG. 2. Since the purpose of condenser section 16 is to give off heat collected from evaporator section 14, the condenser section 16 is positioned outwardly from the stack 12 and cooling efficiency is increased by enclosing the condenser section 16 within the coolant jacket 18. An annular flange 17 mounts the coolant jacket 18 to the heat pipe 10. A circulating flow of coolant is provided to the jacket 18 between inlet 22 and outlet 24.

Working fluid, such as heated liquid potassium, is introduced to the heat pipe 10 at a base fitting 29 as is illustrated in FIG. 1. Heat from the effluent vaporized metal, such as magnesium, subjects the evaporator section 14 to elevated temperatures which changes the phase of the liquid metal working fluid, such as potassium, to a gaseous form. The gaseous potassium collects in the condenser section 16 where it is cooled to its original phase. By virtue of gravity the potassium liquid in the condenser section 16 returns to the evaporator section 14 for recycling.

Along the external length of the evaporator section 14 are a number of arcuate turbulators 26 which may be added to the invention for mixing the effluent flowing upwardly through the stack thereby minimizing concentration gradients of the condensable gases in the effluent. The result is an increase in the efficiency of heat transfer across the wall of the evaporator section 14. Larger arcuate turbulators 28 and 30 may be positioned at the upper end portion of the evaporator section 14 to enhance this mechanism in regions of reduced concentration of the condensed metal. After contact with these "fins," the recycled liquid medium is gravity fed downwardly for collection (not shown).

The heat pipe 10 is provided with a variable conductance capability so that the heat exchange rate of the heat pipe may be maintained relatively constant over a range of fluctuation in heat load. This is accomplished by providing communication between the condenser section 16 and a reservoir 20 containing non-condensable gas, such as argon or helium. The reservoir introduces its stored gas which establishes an interface with the liquid metal working fluid in the heat pipe. As the heat load in the heat pipe varies, the interface will vary between the working fluid vapor in the condenser section 16 and the non-condensable gas. Thus, as the heat load on the condenser section varies, the interface will also vary to maintain a fairly constant temperature in the evaporator section of the pipe. It should be noted that the utilization of such a reservoir in a heat pipe constitutes prior art and is therefore only illustrated schematically in the figures.

Figure 2:
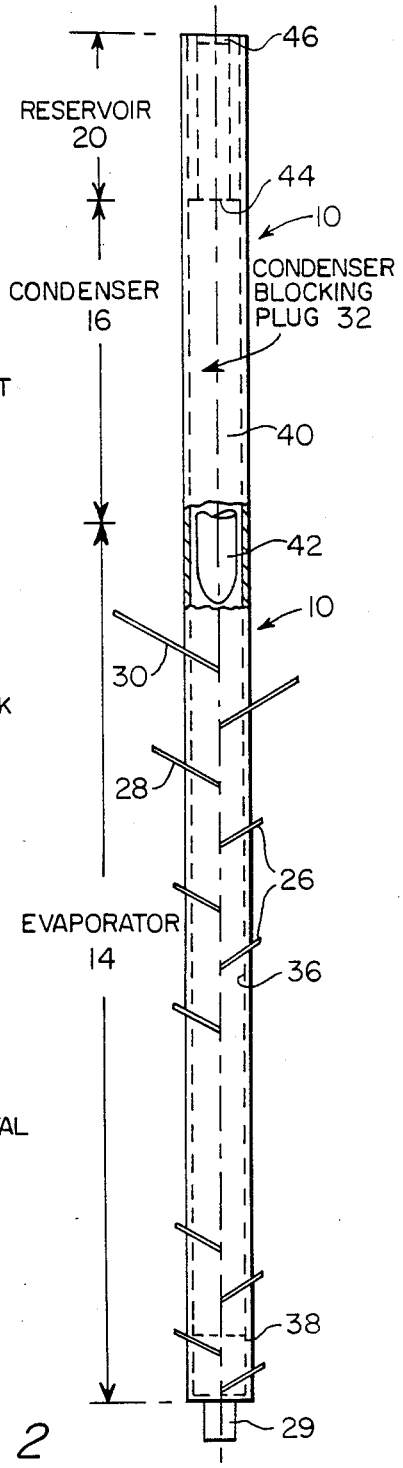
FIG. 2 is a plan view of the present heat pipe construction with the water jacket removed.

FIG. 2 illustrates the structure of the heat pipe in greater detail and with the coolant jacket 18 removed. The reservoir 20 is appropriately secured to the upper end portion of the heat pipe at 46. The lower end 44 of the reservoir 20 is attached to a downwardly extending bullet-shape solid plug 32 which extends through the length of the condenser section 16. The body 40 of the plug 32 terminates in lower nose cone-shaped end 42 which extends somewhat into the upper end portion of the evaporator section 14. The nose cone bullet shape provides higher condenser vapor velocities for improved temperature control and also provides controlled vapor acceleration into the condenser section to minimize axial pressure gradient. The plug is centrally and axially positioned through the median volume of the condenser section 16 but leaves an annular cross section passage between the exterior surface of the plug and the inner diameter of the heat pipe wall. This permits the reflux circulation between the phases of the working fluid within the heat pipe. In order for a variable conductivity heat pipe to operate efficiently, the volume of the reservoir is directly proportional to the volume of the condenser section. The present plug advantageously retains sufficient length of the condenser section to achieve efficient heat exchange across the wall thereof while minimizing the volume of the condenser section. This results in a much smaller reservoir. The end result is a more compact design for the heat pipe.

In order to facilitate the transfer of condensed fluid from the condenser section 16 back to the evaporator section 14, a cylindrical screen 36 is positioned within the heat pipe and extends along the condenser and evaporator sections. The screen serves as a wick which is often included in heat pipe designs and in the present invention the screen may be fabricated from multiple layers including:

coarse mesh for high volume liquid flow (8 mesh)
fine mesh for high entrainment limit (150 mesh)
medium mesh for wall wetting (30 mesh)

As will be appreciated from an understanding of the aforementioned description of the invention, the present design offers a number of advantages. The first is a more compact design since, in this instance, the reservoir is formed by a simple extension of the heat pipe envelope beyond the end of the condenser section. Further, by eliminating the need for a separate gas reservoir with a connecting tube, as has been done by the prior art, there results a more rugged design. A further important advantage is improved variable conductance control since the reduced vapor space cross-sectional area results in a higher condenser vapor velocity and this, in turn, leads to a smaller and more sharply defined interfacial region between the flowing vapor and the non-condensable gas.

It should be understood that the invention is not limited to the exact details of construction shown and described herein for obvious modifications will occur to persons skilled in the art.

We claim:

1. A heat pipe assembly for collecting preselected metals from vapors present in an effluent-emitting stack, the assembly comprising:

a generally cylindrical heat pipe housing axially extending through an upper end portion of a stack;

a plurality of spaced arcuately shaped turbulators connected to the housing for mixing a stream of vapor-containing effluent flowing along the length of the pipe and improving heat transfer between the vapor and the heat pipe;

an evaporator section existing along a lower portion of the pipe and located entirely within the stack for cooling the metal vapors flowing across the evaporator section;

a condenser section existing along an upper portion of the pipe and located outside the stack for exchanging heat to a coolant system;

means for introducing a working fluid into the heat pipe;

a reservoir located in the housing and containing non-condensable gas which flows into the condenser section for controlling the conductance of the heat pipe as a directly proportional function of the heat load on the condenser section; and a plug axially extending through the condenser section and having a diameter less tan the inner diameter of the heat pipe housing, thereby creating an annular cross section passage through the condenser section, wherein the plug has a non-blunt bullet shape nose and extending into the condenser section providing higher condenser vapor velocities for improving temperature control and also providing controlled vapor accleration into the condenser section to minimize axial pressure gradient.

2. The structure setforth in claim 1 together with a multi-layered mesh wisk extending between the condenser and evaporator sections for facilitating the transport of working fluid therebetween.

* * * * *